US009027780B2

(12) United States Patent
Attard

(10) Patent No.: US 9,027,780 B2
(45) Date of Patent: May 12, 2015

(54) EGG AND OTHER PRODUCT PACKAGING

(75) Inventor: Jonathan Attard, North Plympton (AU)

(73) Assignee: Solar Eggs IP Pty Ltd, North Plympton, SA (AU)

( * ) Notice: Subject to any disclaimer, the term of this patent is extended or adjusted under 35 U.S.C. 154(b) by 0 days.

(21) Appl. No.: 13/071,634

(22) Filed: Mar. 25, 2011

(65) Prior Publication Data

US 2011/0233100 A1 Sep. 29, 2011

(30) Foreign Application Priority Data

Mar. 26, 2010 (AU) ..... 2010901375

(51) Int. Cl.
*B65D 85/32* (2006.01)

(52) U.S. Cl.
CPC ..... *B65D 85/32* (2013.01)

(58) Field of Classification Search
CPC ..... B65D 85/32
USPC ..... 220/508, 507, 505, 526, 531, 367.1, 220/406, 4.22, 4.24, 4.21, 4.23; D9/762, D9/757
See application file for complete search history.

(56) References Cited

U.S. PATENT DOCUMENTS

| | | | | |
|---|---|---|---|---|
| 3,128,933 | A * | 4/1964 | Hohnjec | 229/406 |
| 3,655,110 | A * | 4/1972 | Eisenbach | 229/406 |
| 4,081,123 | A | 3/1978 | Reifers | |
| 5,590,805 | A * | 1/1997 | Knoss et al. | 220/508 |
| 6,168,021 | B1 * | 1/2001 | Herbruck | 206/541 |
| 6,488,152 | B1 * | 12/2002 | Steffann | 206/521.1 |
| 6,962,263 | B2 * | 11/2005 | Cadiente et al. | 220/366.1 |
| 7,255,231 | B2 * | 8/2007 | Andrews et al. | 206/521.1 |
| 7,413,094 | B2 * | 8/2008 | Cadiente et al. | 220/23.88 |

FOREIGN PATENT DOCUMENTS

| | | |
|---|---|---|
| AU | 318033 S | 2/2008 |
| AU | 318034 S | 2/2008 |
| AU | 318035 S | 2/2008 |

* cited by examiner

*Primary Examiner* — Fenn Mathew
*Assistant Examiner* — Don M Anderson
(74) *Attorney, Agent, or Firm* — Sand & Sebolt

(57) ABSTRACT

An egg carton includes a base and a lid that are hinged together through a web. The base and lid may include side walls extending around the base and the lid, the base including at least one egg cup for receiving an egg but typically around six. The base further includes at least one compartment in the base for containing other ingredients than eggs, such as bacon. The lid and base include co-operating members arranged so that when the lid is closed on the base the co-operating members ensure that there is a gap between the side walls of the lid and base to allow the flow of air into and out of the carton. This ensures that no moisture collects in the carton that can affect the longevity of the eggs and other ingredients.

19 Claims, 3 Drawing Sheets

EGG AND OTHER PRODUCT PACKAGING

FIELD OF THE INVENTION

The present invention relates to an egg carton including one or more unique compartments for containing other types of products or ingredients to be sold and used with the eggs sold and contained within the carton.

BACKGROUND OF THE INVENTION

It is known to provide an egg carton that can accommodate other ingredients by providing a separate space within the carton to accommodate the other ingredients. However, these cartons do not prevent the contents of the other ingredients from mixing with the eggs. They are also very small not accommodating larger or longer ingredients such as bacon rashers. In addition they do not provide for sufficient air flow around the eggs and/or other ingredients to prevent moisture condensation. Thus there is currently no practical and commercially feasible carton that can provide the consumer with a carton containing eggs and other ingredients that has sufficient longevity or size to make it commercially feasible.

In addition, there is currently no known egg carton that provides sufficient space for other ingredients carton to make a whole dish or meal. Thus there is a need for a carton that can accommodate eggs and other ingredients that ensure that condensation is minimised if not eliminated and where there are sufficient ingredients to make a satisfactory meal.

OBJECT OF THE INVENTION

The object of this invention is to provide an egg and other ingredient carton that can overcome at least some of the above mentioned problems or that provides a useful alternative.

It is a further object of the present invention to provide for an egg and other ingredient carton that minimises moisture condensation that can affect the quality and longevity of the eggs.

SUMMARY OF THE INVENTION

In a broad aspect the invention could be said to reside in an egg carton including;

a base and a lid hinged together through a web, each of the base and lid including side walls extending around the base and the lid, the base including at least one egg cup for receiving an egg;

at least one compartment in the base for containing other ingredients than eggs;

the lid and base including co-operating members so arranged that when the lid is closed on the base the co-operating members ensure that there is a gap between the side walls of the lid and base to thereby allow the flow of air into and out of the carton.

In preference the co-operating members include a projection extending from the lid, the projection engaging a cavity in the base whose depth is less then the length of the projection thereby providing the air gap.

In preference the egg carton includes a plurality of protrusions extending from the base and adapted to engage the lid to prevent the lid from contacting the eggs.

In a further form of the invention there is proposed an egg carton including;

a base and a lid hinged together through a web, each of the base and lid including side walls and a front wall extending around the base and the lid, the base including at least one egg cup for receiving an egg;

at least one compartment in the base for containing other ingredients than eggs;

the lid and base including co-operating members, each co-operating member including a first platform and a second platform extending from the first platform wherein the size of the second platform is smaller then the first platform, the co-operating members so arranged that when the lid is closed on the base the second platform of the lid co-operating member abuts the second platform of the base co-operating member resulting in a gap between the side walls and front wall of the lid and base to thereby allow the flow of air into and out of the carton.

In preference the carton is of a rectangular shape and the co-operating members are located on each corner of the carton.

In preference there are further co-operating members located at the front of the carton, the base second platform and the lid second platform so shaped to allow these co-operating members to mate in a female to male arrangement.

In preference there is a plurality of egg cups.

In preference the carton further includes co-operating engaging means so that when the lid is closed on the base it is locked in place.

The side walls may extend wholly around the base or the lid, but may also extend partially and it is not intended to limit the invention to side walls. In some cases it may be possible that the lid does not have side walls at all—just protrusions and no side walls on say the shorter sides.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

Figure 1:
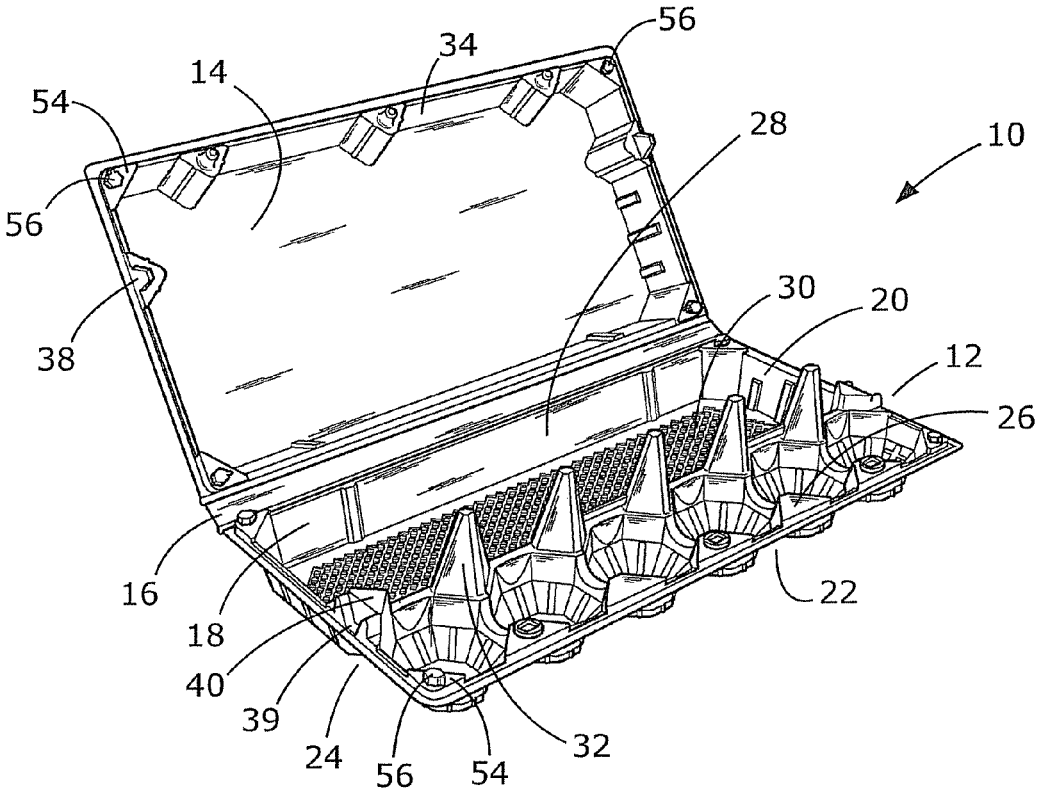
FIG. 1 is a perspective view of one embodiment of an egg and other ingredients carton that is the subject of the present invention, when in an open position.
Figure 2:
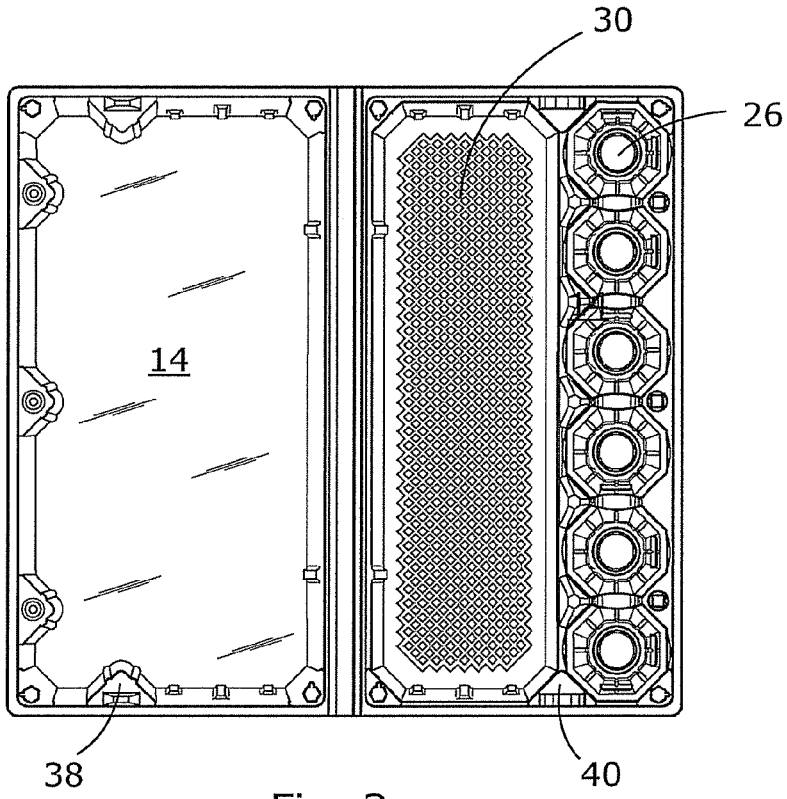
FIG. 2 is a top view of the carton of FIG. 1.
Figure 3:
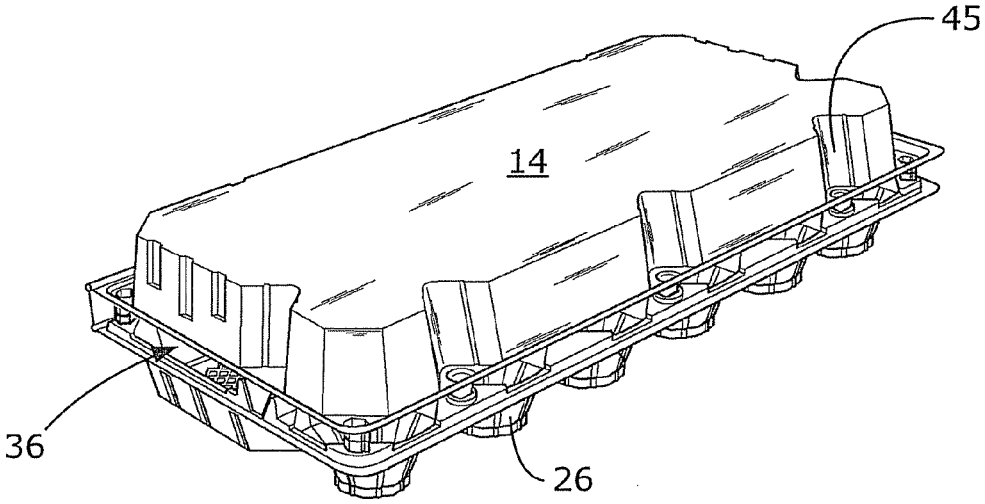
FIG. 3 is a perspective view of the carton as in FIG. 1 but when in closed position.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts. Dimensions of certain of the parts shown in the drawings may have been modified and/or exaggerated for the purposes of clarity or illustration.

Referring to the drawings there is illustrated an egg and other ingredients carton 10 having a base 12 and a lid 14 attached to each other through web 16. The base 12 is generally of a rectangular configuration and includes four integral side walls 18, 20, 22 and 24. Disposed at the front of the base are cup-like receptacles 26, in this embodiment there being six of them extending across the base 12. Located adjacent the receptacles 26 is a compartment 28 having a rippled floor 30 and defined by side wall 18, partially by side walls 20 and 24 and by an intermediate wall 30. The compartment is intended to be used for other ingredients such as bacon, sausages, tomatoes and indeed any other food stuff that people may enjoy eating with eggs. However the compartment may equally well be used for other things, such as paint and brushes for children to decorate the eggs with.

Whilst the embodiment illustrates side walls extending around the base and the lid it is to be understood that the side walls may be partial and not extend wholly around either the lid or the base.

The used of the rippled floor 30 is to ensure that if there is any moisture on the floor the ingredients are lifted away from it thereby ensuring the quality of the ingredients. Extending upwardly from the intermediate wall are projections 32 whose height is designed to engage the lid 14 when it is closed and are of a sufficient height to ensure that the eggs are not in direct contact with the lid thus protecting them from damage.

Figure 4:
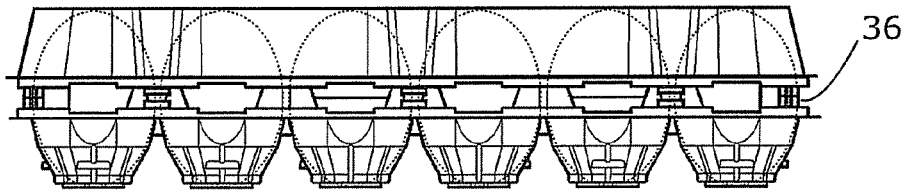
FIG. 4 is a side view of the carton when in a closed position.
Figure 5:
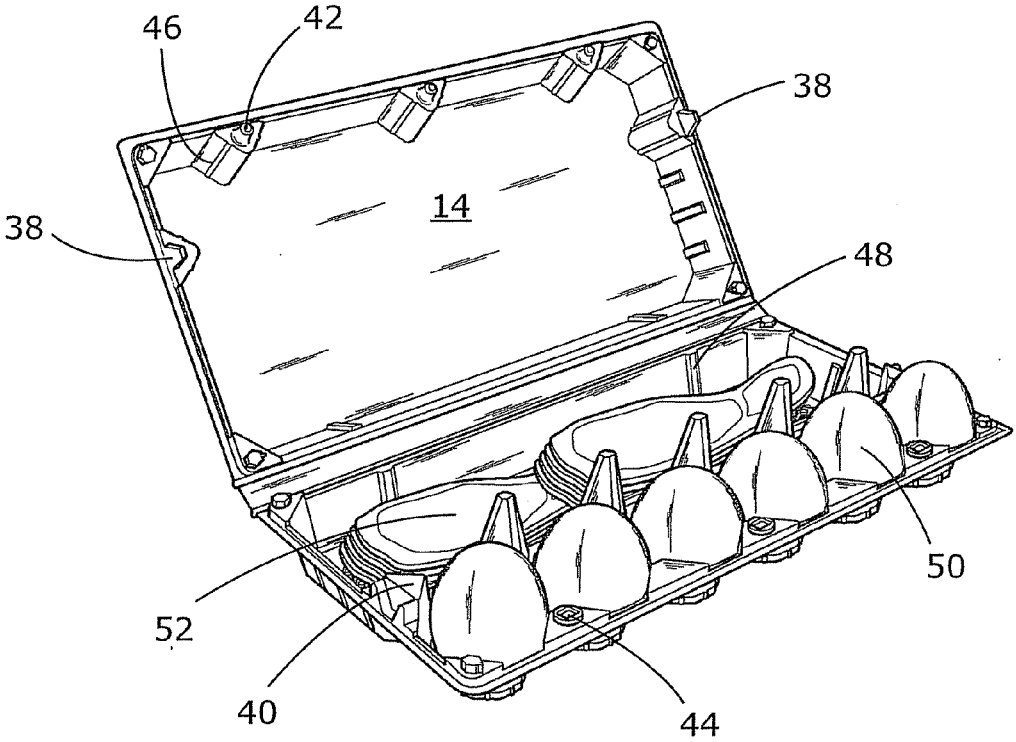
FIG. 5 is the carton as in FIG. 1 but when holding eggs and other ingredients.

Lid 14 also includes side walls that are of a size and dimension to closely abut the side walls of the base. Thus, for example, lid side wall 34 is adjacent base side wall 22 and so on. However an important aspect of the invention is that there be an air gap 36 between the lid and the base when the carton is closed. This air gap ensures that there is sufficient air flow through the carton to prevent any moisture from being trapped in the carton. This is best seen in FIG. 4, where the air gap 36 is clearly illustrated. The height of the air gap is defined by the width of the web 16 joining the lid 14 to the base 12.

To ensure that the air gap is maintained, the lid further includes projections 38 that engage a cavity 39 adjacent platform 40 in the base thus maintaining the air gap 36 and ensuring the lid is effectively locked in place to the base in so far as lateral movement is concerned. Other features of the carton include those well known in the art such as mating male and female parts 42 and 44 that keep the lid in the closed position. To enable the user to press on these mating parts there are provided indents 45 in the lid.

To provide for strength in the carton various ribs may be provided through the carton such as ribs 46 in the lid and ribs 48 in the base. Typically the carton is moulded from food-grade plastic material that is transparent and enables the consumer to view both the eggs 50 and other ingredients such as bacon 52.

The reader will also appreciate that located at each corner of the carton is a triangular platform 54 from which extends a second platform 56 whose size or footprint is smaller then the first platform. Thus in this embodiment the first platform is a triangular shaped one whilst the second is a cylindrically shaped one. Such an arrangement exists at all four corners of the carton so that when the lid 14 is closed the second platform from the lid and from the base about defining the air gap 36 to allow for air flow into and out of the carton. Of course it is not intended to limit either platform to a particular size and configuration.

It is to be understood that although the above embodiment described there being a row of six eggs with an adjacent compartment, the carton may equally well have other designs such as additional eggs in multiple rows. Thus although not shown, the carton may well have a central area housing 6 eggs with outer compartments on either side.

As can be seen in the drawings the carton when moulded has various features that are common to the trade, such as the ribs, that add strength to the carton as a whole and it is not intended to discuss those in detail being common knowledge in the field.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. An egg carton comprising:

a base and a lid hinged together through a web, each of the base and lid including side walls and a front wall extending around the base and the lid;

at least one egg cup in the base for receiving an egg;

at least one compartment in the base for containing ingredients other than eggs;

co-operating members provided on each of the base and the lid; each co-operating member including a first platform and a second platform and the size of the second platform is smaller than the first platform; where the first platform extends outwardly from an outermost edge of one of the side walls of the base or lid and the second platform extends outwardly from an outer surface of the first platform; and wherein the outer surface of the first platform is located a first distance from the outermost edge of the lid or base and an outer surface of the second platform is located a second distance from the outermost edge and the second distance is greater than the first distance; and wherein the co-operating members are so arranged that when the lid is closed on the base, the second platform of the lid co-operating member abuts the second platform of the base co-operating member resulting in a gap between the outermost edges of the side walls and front wall of the lid and base to thereby allow the flow of air into and out of the carton.

2. The egg carton of claim 1, wherein the web extends between an outermost edge of a back wall of the base and an outermost edge of a back wall of the lid; and the web has a width as measured between the outermost edges of the back walls of the base and lid; and wherein the height of the gap between the outermost edges of the lid and base is defined by the width of the web.

3. The egg carton as in claim 1, wherein there is a plurality of protrusions extending from the base and beyond the outermost edge of the base and engaging the lid and adapted to prevent the lid from contacting an egg retained in the carton.

4. The egg carton as defined in claim 3, wherein each protrusion is generally pyramidal in shape.

5. The egg carton as defined in claim 4 wherein the protrusions are spaced at intervals from each other and are aligned in a row.

6. The egg carton as defined in claim 5, where the row of protrusions is aligned substantially parallel to the front wall of the base.

7. The egg carton as defined in claim 1, wherein the lid has an interior surface and the interior surface is planar.

8. The egg carton as in claim 1, wherein there is a plurality of egg cups and the at least one compartment is a single compartment.

9. The egg carton as defined in claim 8, wherein the single compartment is generally rectangular when viewed from above and each of the plurality of egg cups is generally circular when viewed from above.

10. The egg carton as defined in claim 8, wherein the plurality of egg cups is arranged in at least one row that extends between the side walls of the base; and a plurality of protrusions is located between the single compartment and the row of egg cups.

11. The egg carton as defined in claim 8, wherein the single compartment includes a floor and a plurality of ripples is provided in the floor.

12. The egg carton as defined in claim 8, wherein the base is generally rectangular in shape and further includes a back wall opposed to the front wall thereof; and wherein the single compartment extends between the side walls of the base.

13. The egg carton as defined in claim 12, wherein the single compartment further extends from proximate one of the front and back walls to approximately mid-way between the front and back walls.

14. The egg carton as in claim 1, wherein the carton is of a rectangular shape and the co-operating members are located adjacent each corner of the carton.

15. The egg carton as defined in claim 1, wherein the at least one egg cup is of a first size that is substantially equal in size to the egg it is adapted to receive; and wherein the at least one compartment is of a second size that is greater than the first size.

16. The egg carton as in claim 1, wherein the carton is of a rectangular shape and the co-operating members are located on each corner of the carton.

17. The egg carton as in claim 1, wherein the carton further includes co-operating engaging means so that when the lid is closed on the base it is locked in place.

18. The egg carton as in claim 1, wherein there are further co-operating parts located at a front of the carton, the base second platform and the lid second platform so shaped to allow these front co-operating parts to mate in a female to male arrangement.

19. The egg carton as in claim 18, wherein the co-operating parts include a projection extending from the lid, the projection engaging a cavity defined in the base whose depth is less than the length of the projection thereby providing the air gap.

* * * * *